United States Patent [19]

Browder, Jr. et al.

[11] Patent Number: 4,875,241

[45] Date of Patent: Oct. 24, 1989

[54] PANTYHOSE WITH PANTY HAVING COTTON CHARACTERISTICS

[75] Inventors: George A. G. Browder, Jr., Germantown, Tenn.; David W. Grant, Grenada, Miss.

[73] Assignee: Esmark Apparel, Inc., New York, N.Y.

[21] Appl. No.: 257,840

[22] Filed: Oct. 14, 1988

[51] Int. Cl.[4] ..... A41B 11/04

[52] U.S. Cl. ..... 2/409; 2/243 A; 66/177; 66/169 R

[58] Field of Search ..... 2/227, 239, 409, 243 A, 2/400; 66/176, 178 R, 182, 177, 178 A, 169 R

[56] References Cited

U.S. PATENT DOCUMENTS

| | | | |
|---|---|---|---|
| 376,373 | 1/1888 | Dodge et al. | 66/177 |
| 2,382,125 | 4/1958 | Knohl | 2/239 |
| 3,449,932 | 6/1969 | Fillmore et al. | 2/239 |
| 3,595,034 | 7/1971 | Safrit | 2/409 |
| 3,678,515 | 7/1972 | Wehrmann | 2/409 |
| 3,757,354 | 9/1973 | Moody | 66/177 X |
| 3,760,611 | 9/1973 | Duckworth | 66/177 |
| 3,956,906 | 5/1976 | Cassidy, Sr. | 66/177 X |
| 4,023,384 | 5/1977 | Conti et al. | 66/177 X |
| 4,065,942 | 1/1978 | Kejnovsky et al. | 66/177 |
| 4,213,312 | 7/1980 | Safrit et al. | 66/177 |
| 4,412,433 | 11/1983 | Safrit et al. | 66/177 |

FOREIGN PATENT DOCUMENTS

| | | | |
|---|---|---|---|
| 636982 | 2/1962 | Canada | 66/177 |

*Primary Examiner*—Werner H. Schroeder
*Assistant Examiner*—Sara M. Current
*Attorney, Agent, or Firm*—Bell, Seltzer, Park & Gibson

[57] ABSTRACT

The cotton characteristics are provided in the panty portion of the pantyhose of the present invention by knitting alternate single courses of the panty portion of a thermoplastic yarn and a much larger cotton yarn in plated relationship with the thermoplastic yarn. Stretchable characteristics are provided in the panty portion of the pantyhose by knitting intervening single courses of the panty portion of a thermoplastic yarn and a plated spandex yarn. The much larger cotton yarn, knit in alternate single courses, is predominant on both the inside and outside of the panty portion. The sheer legs of the pantyhose are formed by merely discontinuing the knitting of the cotton yarn in alternate single courses of the leg and discontinuing the knitting of the thermoplastic yarn so that the legs are formed of alternate single courses of thermoplastic yarn and intervening single courses of spandex yarn.

8 Claims, 1 Drawing Sheet

PANTYHOSE WITH PANTY HAVING COTTON CHARACTERISTICS

FIELD OF THE INVENTION

This invention relates generally to pantyhose with relatively sheer legs and an opaque panty portion having cotton characteristics, and more particularly to such a pantyhose in which the panty portion includes alternate single courses knit of a thermoplastic yarn and a cotton yarn in plated relationship, and intervening single courses knit of a thermoplastic yarn and a spandex yarn in plated relationship to provide the feel and moisture absorbing characteristics of cotton in the panty portion.

BACKGROUND OF THE INVENTION

It has been generally recognized to be desirable to provide the panty portion of pantyhose with the feel and moisture absorbing characteristics of cotton by providing cotton characteristics in the panty portion of the pantyhose. It is believed that the provision of cotton characteristics in the panty portion will encourage the purchaser to wear only the pantyhose, without a conventional panty either over or under the pantyhose.

Safrit et al U.S. Pat. No. 4,213,312 discloses a pantyhose with a stretch-cotton panty portion which is knit throughout of a textured stretchable thermoplastic body yarn with a cotton yarn knit in plated relationship with the body yarn in every fourth course of the panty portion. The presence of the cotton yarn in spaced-apart courses of the panty portion is said to provide a sufficient quantity of the feel and moisture absorbing characteristics of cotton on the inside of the panty portion to prevent any wet or "clammy" feeling on the body of the wearer. However, the spacing of the cotton yarn in every fourth course of the panty portion may not provide a sufficient quantity of cotton uniformly distributed on the inner face of the panty portion to provide the desirable feel and moisture absorbing characteristics of cotton.

Moody U.S. Pat. No. 3,757,354 discloses a pantyhose in which the panty portion includes cotton yarn terry loops forming a thick cushion surface on the inner portion thereof. The thick cushion surface is formed by knitting a cotton yarn in plated relationship with a nylon ground or body yarn in each course of the panty portion. While this type of inner surface on the panty portion does provide softness and absorbency, the knitting of the cotton yarn in every course of the panty portion tends to restrict the stretchability of the pant portion, as well as its breathability.

Duckworth U.S. Pat. No. 3,760,611 discloses a pantyhose in which every fourth course is knit of cotton yarn only while the intervening three courses are knit of nylon. The courses of cotton yarn form stitch loops in spaced-apart wales with tucks therebetween to form free loops of the cotton yarn protruding inwardly of the panty portion. The inner face of the panty portion of the pantyhose of this patent does include some of the feel and moisture absorbing characteristics of cotton. However, the knitting of every fourth course solely of cotton may tend to restrict the stretchability of the panty portion and the inwardly protruding free loops of cotton yarn may be objectionable.

SUMMARY OF THE INVENTION

With the foregoing in mind, it is an object of the present invention to provide a pantyhose including relatively sheer legs and a panty portion which includes the feel and moisture absorbing characteristics of cotton while substantially retaining the desirable lightweight and stretchable characteristics in the panty portion. These characteristics are obtained in the panty portion of the present pantyhose by uniformly spacing the cotton yarn throughout the panty portion by knitting the cotton yarn in plated relationship with a thermoplastic yarn in alternate single courses, and while knitting a spandex yarn in plated relationship with a thermoplastic yarn in intervening single courses so as to uniformly distribute the cotton yarn in closely spaced courses throughout the panty portion of the pantyhose.

In accordance with the present invention, the panty portion of the pantyhose has the feel and moisture absorbing characteristics of cotton and the stretch characteristics of the spandex yarn. The cotton yarn is much larger than the thermoplastic yarn with which it is plated so that the cotton yarn is predominant on both the inside and outside of the panty portion. The relatively sheer legs of the present pantyhose are knit with alternate single courses of thermoplastic yarn and intervening single courses of spandex yarn.

In the embodiment illustrated, the panty portion includes alternate single courses knit of 15/7 denier raw nylon plated with 50 single count cotton yarn, while intervening single courses of the panty portion are knit of 30/10 denier stretch nylon plated with 20 denier spandex yarn having a 10/7 denier nylon single cover. The stretch nylon yarn and the spandex yarn provide stretch characteristics to the panty portion while the cotton yarn provides the feel and moisture absorbing characteristics of cotton to the panty portion.

A panty portion knit in this manner and with these types of yarns comprises substantially 60% cotton, 30% nylon, and 10% spandex. The panty portion provides the comfort and tactile properties of cotton, the strength properties of nylon, and the stretch/recovery characteristics of spandex. The panty portion is relatively opaque for modesty reasons so that the garment can be worn without panties to thereby eliminate uncomfortable, unsightly, and potentially unhealthy layering of clothing. The panty can be of the bikini type or it can be of the full panty type with short leg portions. In either case, the leg portions are integrally knit with the lower ends of the panty leg openings. The legs are preferably relatively sheer and are knit with alternate single courses of a 15/7 denier raw nylon and intervening single courses of a 20 denier spandex yarn having a 10/7 denier nylon single cover to provide a satisfactory sheer appearance and sufficient stretchability to fit a range of leg and foot sizes.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENT

Figure 1:
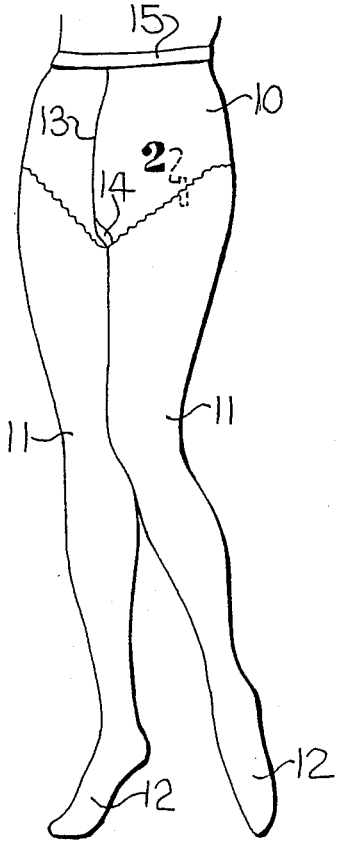
FIG. 1 is a perspective front view of a pantyhose constructed in accordance with the present invention and illustrating the same in substantially the condition the pantyhose assumes when being worn.

As shown in FIG. 1, the present pantyhose includes a panty portion 10 with integrally knit leg portions 11 and foot portions 12. The panty portion 10 is illustrated as being formed in the conventional manner by forming longitudinal or walewise slits extending downwardly from the upper end portions of a pair of elongated stocking blanks. The adjacent slit edges are joined together along a seam line, as indicated at 13, extending from the front upper waist and downwardly through the crotch and upwardly to the rear upper waist. If desired, a suitable crotch patch 14 may be incorporated in the seam 13. The upper portion of the panty may be provided with an elastic turned welt, or with an elastic tape or band 15 to form a suitable elastic waist opening.

Figure 2:
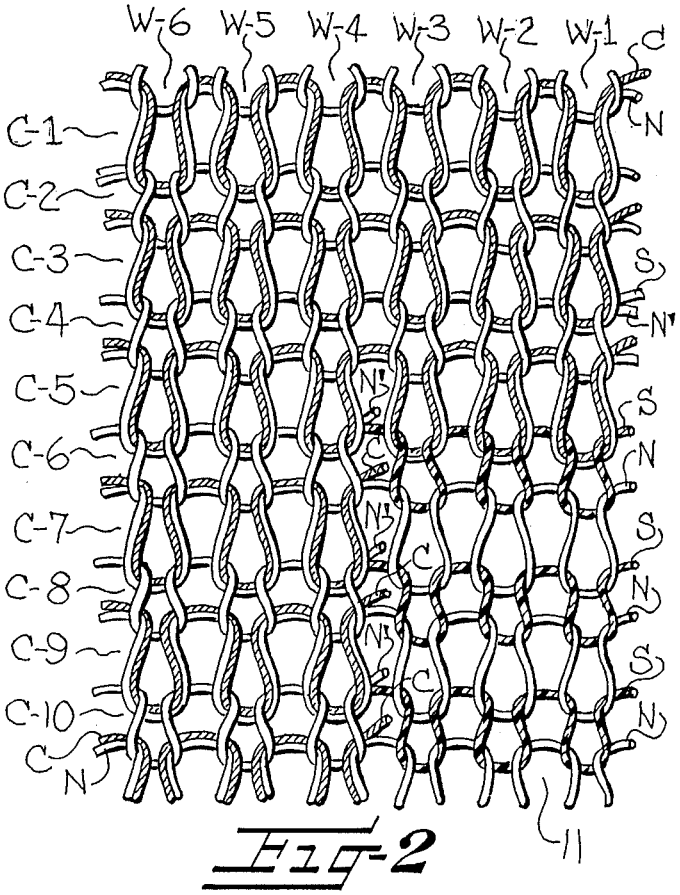
FIG. 2 is a fragmentary enlarged view of a small area of the fabric adjacent the lower edge of the panty and the upper edge of the leg, being taken substantially in the area enclosed by the rectangle 2 in FIG. 1.
Figure 3:
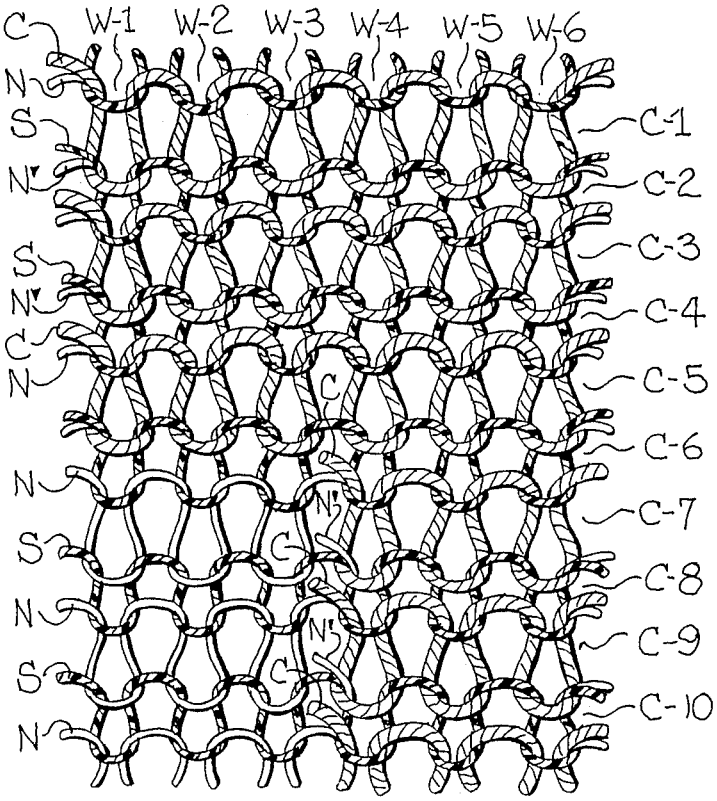
FIG. 3 is a view similar to FIG. 2 but looking at the reverse side of the fabric.

As illustrated in the partial courses C-1 through C-10 and the partial wales W-1 through W-6 of FIGS. 2 and 3, each course of the panty portion 10 is knit with a pair of yarns in plated relationship while each course of the legs 11 is knit with a single yarn. Thus, the panty portion 10 is more dense, heavier, and more opaque than the sheer legs 11. Alternate single courses of the panty portion 10 are knit of a thermoplastic yarn N and a cotton yarn C in plated relationship, as illustrated in all wales of courses C-1, C-3 and C-5, and in wales W-4, W-5 and W-6 of courses C-7 and C-9. Intervening single courses of the panty portion 10 are knit of a thermoplastic yarn N' and a spandex yarn S in plated relationship, as illustrated in all wales of courses C-2 and C-4 and in wales W-4, W-5 and W-6 of courses C-6, C-8 and C-10. On the other hand, alternate single courses of the leg 11 are knit of only the thermoplastic yarn N, as illustrated in wales W-1, W-2 and W-3 of courses C-7 and C-9, while intervening single courses of the leg portion 11 are knit only of the spandex yarn S, as illustrated in wales W-1, W-2 and W-3 of courses C-6, C-8 and C-10.

In the panty portion 10, the cotton yarn C is much larger than the thermoplastic yarns N, N' and the spandex yarn S, as illustrated in FIGS. 2 and 3, so that the cotton yarn C is predominantly on both the outside and the inside of the panty portion 10. It is to be understood that the fabric illustrated in FIGS. 2 and 3 is stretched in both the coursewise and walewise directions. When the fabric is relaxed, the spandex yarn S and the thermoplastic yarn N' in the intervening single courses (even numbered courses) contract to draw together the stitch loops of the cotton yarn C and the thermoplastic yarn N in the alternate single courses (odd numbered single courses).

It has been found that a very desirable pantyhose can be produced in accordance with the present invention by knitting alternate single courses of the panty portion 10, as illustrated in the odd numbered courses of FIG. 2, of a nonstretchable 15/7 denier raw or nonstretchable nylon yarn N in plated relationship with a 50 single count cotton yarn C, and while knitting intervening single courses of the panty portion 10, as illustrated in the even numbered courses of FIG. 2, of a textured stretchable 30/10 denier nylon yarn N' plated with a 20 denier Lycra yarn S which is covered with a single cover of 10/7 denier nylon. The 50 single count cotton C has a size which is approximately equivalent to 110 denier. Thus, the cotton yarn C is approximately 7⅓ times as large as the nonstretchable nylon yarn N with which it is plated in alternate single courses of the panty portion and the total denier of these alternate single courses is approximately 125 denier. The total denier of the spandex yarn S and the stretchable nylon yarn N' in the intervening single courses (including the cover of the spandex yarn) is approximately 60 denier, or one-half as large as the total denier of the alternate single courses.

The pantyhose will be described as being knit on a conventional four feed Lonati Model L303P knitting machine having 400 needles in a 4-inch cylinder. However, it is to be understood that the present pantyhose may be knit on other conventional types of seamless knitting machines. Identical elongated seamless stocking blanks are knit on the machine in the same manner and are then slit longitudinally in a walewise direction and downwardly from the upper ends so that two of the elongated stocking blanks can be connected by a U-seam to form the panty portion 10 with the legs 11 extending downwardly therefrom. It is preferred that the waistband 15 be formed by knitting an inwardly turned welt with nylon and spandex yarn on the upper end of the elongate stocking blank. Knitting of the panty portion 10 is then carried out by feeding the cotton yarn C and the thermoplastic yarn N to all needles at two diametrically opposed feeds of the four feed machine, while feeding the spandex yarn S and the thermoplastic yarn N' to all needles at the other two feeding stations.

With each rotation of the needle cylinder, four courses of the panty portion 10 are knit with alternate single courses being knit of the thermoplastic yarn N and the cotton yarn C in plated relationship on all needles and forming plain jersey stitch loops, as illustrated in courses C-1, C-3 and C-5 of FIGS. 2 and 3. Intervening single courses of the panty portion 10, as illustrated in courses C-2 and C-4, are formed of the thermoplastic yarn N' and the spandex yarn S forming plain jersey stitch loops in plated relationship. A sufficient number of courses are knit in this manner down to the high-rise outer opposite portions of the stocking blanks.

At this point, the number of needles knitting both yarns is gradually reduced to produce a stepped pattern along the juncture of the panty 10 and the leg portion 11 so that those needles which begin forming the alternate partial courses at the upper end of the leg portion 11 knit only the thermoplastic yarn N while the cotton yarn C is removed and cut, as illustrated adjacent wale W-4 of alternate single courses C-7 and C-9. The intervening single partial courses at the upper end of the leg 11 are knit only of the spandex yarn S while the thermoplastic yarn N' is removed and cut, as illustrated adjacent wale W-4 in courses C-6, C-8 and C-10. The number of needles knitting both yarns at each knitting station is gradually reduced to produce the stepped pattern and the high-rise type of panty 10 illustrated in FIG. 1.

The knitting of the stepped pattern along the lower edge of the panty portion 10 is carried out in a conventional manner, as for example in the manner disclosed in the Fillmore et al U.S. Pat. No. 3,449,932. The gradual reduction of the length of the partial courses knit of both yarns is continued down to a point below the position where the lower end of the slit is to be formed. Then, all of the alternate single courses of the leg portion 11 are knit entirely of the thermoplastic yarn N while all of the intervening single courses of the leg portion 11 are knit entirely of the spandex yarn S. Knitting in this manner continues throughout the formation of the leg 11 and foot 12 until the proper length has been knit to form one of the pantyhose stocking blanks, and the blank is then shed from the machine. The pantyhose is completed by closing the toe opening in the usual manner and slitting and seaming together the slit inner edges of a pair of the stocking blanks.

While the panty portion 10 is illustrated in FIG. 1 as being of the high-rise type, it is to be understood that the knitting of full courses with both yarns at each knitting station could continue in the knitting of the upper portion of the stocking blank, down to a position below where the lower end of the slit is to be formed. At that point, the knitting of the cotton yarn C and the thermoplastic yarn N' could be simultaneously discontinued at each knitting station so that the leg 11 would be knit with full alternate single courses of the thermoplastic yarn N and full intervening single courses of the spandex yarn S.

The pantyhose of the present invention includes sheer legs 11 and a relatively heavier and a more opaque stretchable panty portion 10 including the feel and moisture absorbing characteristics of cotton. Alternate single courses of the panty portion are knit of a thermoplastic yarn and a much larger cotton yarn in plated relationship with the thermoplastic yarn, and intervening single courses of the panty portion are knit of a thermoplastic yarn and a spandex yarn in plated relationship. The cotton yarn is thus uniformly distributed throughout the panty portion, in alternate single courses, while the spandex yarn is also uniformly distributed throughout the panty portion, in intervening single courses. Since the cotton yarn is much larger than the other yarns knit in the panty portion, the feel and moisture absorbing characteristics of the cotton yarn are predominant throughout the panty portion. In order to integrally knit the relatively sheer legs 11 with the panty portion 10, it is merely necessary to discontinue knitting of the cotton yarn and the thermoplastic nylon yarn and to continue knitting the thermoplastic yarn in alternate single courses while knitting the spandex yarn in intervening single courses. The present pantyhose thus includes a cotton blend panty portion providing the comfort and feel of natural cotton so that the wearer can elect to wear the present pantyhose without wearing conventional panties either under or on top of the pantyhose garment.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A pantyhose including sheer legs and a relatively heavier and more opaque panty portion, said panty portion including the feel and moisture absorbing characteristics of cotton and comprising successive courses formed of adjacent wales of stitch loops, alternate single courses of said panty portion being knit of a thermoplastic yarn and a cotton yarn in plated relationship with said thermoplastic yarn, and intervening single courses of said panty portion being knit of a thermoplastic yarn and a spandex yarn in plated relationship with said thermoplastic yarn, said cotton yarn providing the feel and moisture absorbing characteristics of cotton to said panty portion and said spandex yarn providing stretchability to said panty portion.

2. A pantyhose according to claim 1 wherein said thermoplastic yarn knit in plated relationship with said cotton yarn in said alternate single courses is nonstretchable, and wherein said thermoplastic yarn knit in plated relationship with said spandex yarn in said intervening single courses of said panty portion is a textured stretchable yarn.

3. A pantyhose according to claim 1 wherein the successive courses of said panty portion are knit with plain jersey stitch loops throughout the panty portion.

4. A pantyhose according to claim 1 wherein the total denier of all yarns knit in said alternate single courses is substantially two times as great as the total denier of all yarns knit in said intervening single courses of said panty portion.

5. A pantyhose according to claim 4 wherein said cotton yarn is substantially seven times as large as said thermoplastic yarn with which it is knit in said alternate single courses of said panty portion, and wherein said thermoplastic yarn is substantially the same size as said spandex yarn with which it is knit in plated relationship in said intervening single courses of said panty portion.

6. A pantyhose according to claim 1 wherein said sheer legs comprise alternate single courses knit of a thermoplastic yarn and intervening single courses knit of said spandex yarn.

7. A pantyhose according to claim 1 wherein said thermoplastic yarn knit in said alternate single courses comprises a nonstretch 15/7 denier nylon, said cotton yarn is a 50 single count, said thermoplastic yarn knit in said intervening single courses comprises a stretch 30/10 denier nylon, and said spandex yarn comprises a 20 denier Lycra with a single covering of 10/7 denier nylon.

8. A pantyhose including sheer legs and a relatively heavier and more opaque panty portion, said panty portion including the feel and moisture absorbing characteristics of cotton and comprising successive courses formed of adjacent wales of plain jersey stitch loops, alternate single courses of said panty portion being knit of a nonstretchable thermoplastic yarn and a cotton yarn in plated relationship with said nonstretchable thermoplastic yarn, said cotton yarn being substantially seven times as large as said nonstretchable thermoplastic yarn, and intervening single courses of said panty portion being knit of a stretchable thermoplastic yarn and a spandex yarn in plated relationship with said thermoplastic yarn, said stretchable thermoplastic yarn and said spandex yarn being of substantially the same size, said larger cotton yarn being predominant throughout said panty portion and providing the comfort and feel of natural cotton to said panty portion.

* * * * *